US006814281B2

(12) United States Patent
Anderson et al.

(10) Patent No.: US 6,814,281 B2
(45) Date of Patent: Nov. 9, 2004

(54) MULTI-VOLTAGE CASH DRAWER

(75) Inventors: Eric L. Anderson, St. Louis Park, MN (US); Paul St. George, Vadnais Heights, MN (US); Bob P. Daugs, Shoreview, MN (US)

(73) Assignee: APG Cash Drawer, a division of Upper Midwest Industires, Minneapolis, MN (US)

( * ) Notice: Subject to any disclaimer, the term of this patent is extended or adjusted under 35 U.S.C. 154(b) by 176 days.

(21) Appl. No.: 10/035,523

(22) Filed: Oct. 19, 2001

(65) Prior Publication Data

US 2003/0075595 A1 Apr. 24, 2003

(51) Int. Cl.[7] ..... G07G 1/00
(52) U.S. Cl. ..... 235/22; 235/379
(58) Field of Search ..... 235/22, 379

(56) References Cited

U.S. PATENT DOCUMENTS

| | | | | | |
|---|---|---|---|---|---|
| 3,899,775 | A | * | 8/1975 | Larsen | 705/21 |
| 4,035,792 | A | * | 7/1977 | Price et al. | 396/427 |
| 4,268,823 | A | * | 5/1981 | Rauchut et al. | 340/570 |
| 4,752,874 | A | * | 6/1988 | Meyers | 705/18 |

* cited by examiner

*Primary Examiner*—Karl D. Frech
(74) *Attorney, Agent, or Firm*—Joseph R. Kelly; Westman, Champlin & Kelly, P.A.

(57) ABSTRACT

In one embodiment of the present invention, a cash drawer is provided which can have its drawer latch solenoid actuated by one of a plurality of different voltages. The plurality of different voltages can include at least three different voltages. In another illustrative embodiment, the cash drawer of the present invention provides a multi-voltage cash drawer with fly-back protection.

21 Claims, 3 Drawing Sheets

MULTI-VOLTAGE CASH DRAWER

BACKGROUND OF THE INVENTION

The present invention relates to cash drawers. More specifically, the present invention relates to a cash drawer configured to receive multiple different actuation signals to open the cash drawer.

Conventional cash drawers are supported by slides or other types of bearings such that they can reciprocate into and out of a housing or frame. Such cash drawers are conventionally spring biased into the open position, but are latched in the closed position by a solenoid-driven latch.

In the past, the solenoids have often been actuated by a 12V signal or a 24V signal, depending on the particular control system in which the cash drawers were implemented. This provides a number of disadvantages. For example, manufactures and distributors of cash drawers are required to carry additional inventory such that an adequate supply of cash drawers with 12V solenoids and cash drawers with 24V solenoids are in stock. This is undesirable because of the increased cost involved.

In order to address this problem, some manufacturers developed cash drawers having dual voltage solenoids therein. However, in order to select between the various voltages, such cash drawers have often required internal jumpers to be manipulated on internal terminal blocks. Other manufacturers have provided two solenoids and expensive and bulky cable sets (such as DB9 cable connectors) have been required to select one of the two solenoids.

Still other solutions to the problem have provided solenoids in a cash drawer wherein each of the solenoids can be activated by a different voltage. However, those voltages are selected by an internal switch. Such switches are located internal to the cash drawer electronics.

Each of these different types of solutions have provided significant disadvantages. Requiring access to the internal electronics of the cash drawer can be problematic and require additional complexity in configuring a cash drawer for a particular vendor. Providing large, bulky cables (such as DB9 connectors) can be quite expensive in that they require a great deal of labor to assemble, which is undesirable. Similarly, none of the prior cash drawers have provided compatibility with more than two different voltages.

In addition, prior cash drawers have suffered from other disadvantages. For example, in order to actuate the solenoid in the cash drawer, the coil associated with the solenoid must be energized. However, when the coil de-energizes, if adequate protection is not provided, the de-energization current can damage external components to which the cash drawer is electronically connected, such as printers. Protection against this type of de-energization is referred to as fly-back protection, and many prior cash drawers have not provided fly-back protection.

SUMMARY OF THE INVENTION

In accordance with the present invention, a cash drawer is provided which can have its drawer latch solenoid actuated by one of a plurality of different voltages. In one embodiment, the plurality of different voltages includes at least three different voltages.

In another illustrative embodiment, the cash drawer of the present invention provides a multi-voltage cash drawer with fly-back protection. In one such embodiment, the fly-back protection is provided with a diode circuit wherein the diode circuit acts to direct current to appropriate coils in the solenoid.

DETAILED DESCRIPTION OF THE ILLUSTRATIVE EMBODIMENTS

Figure 1:
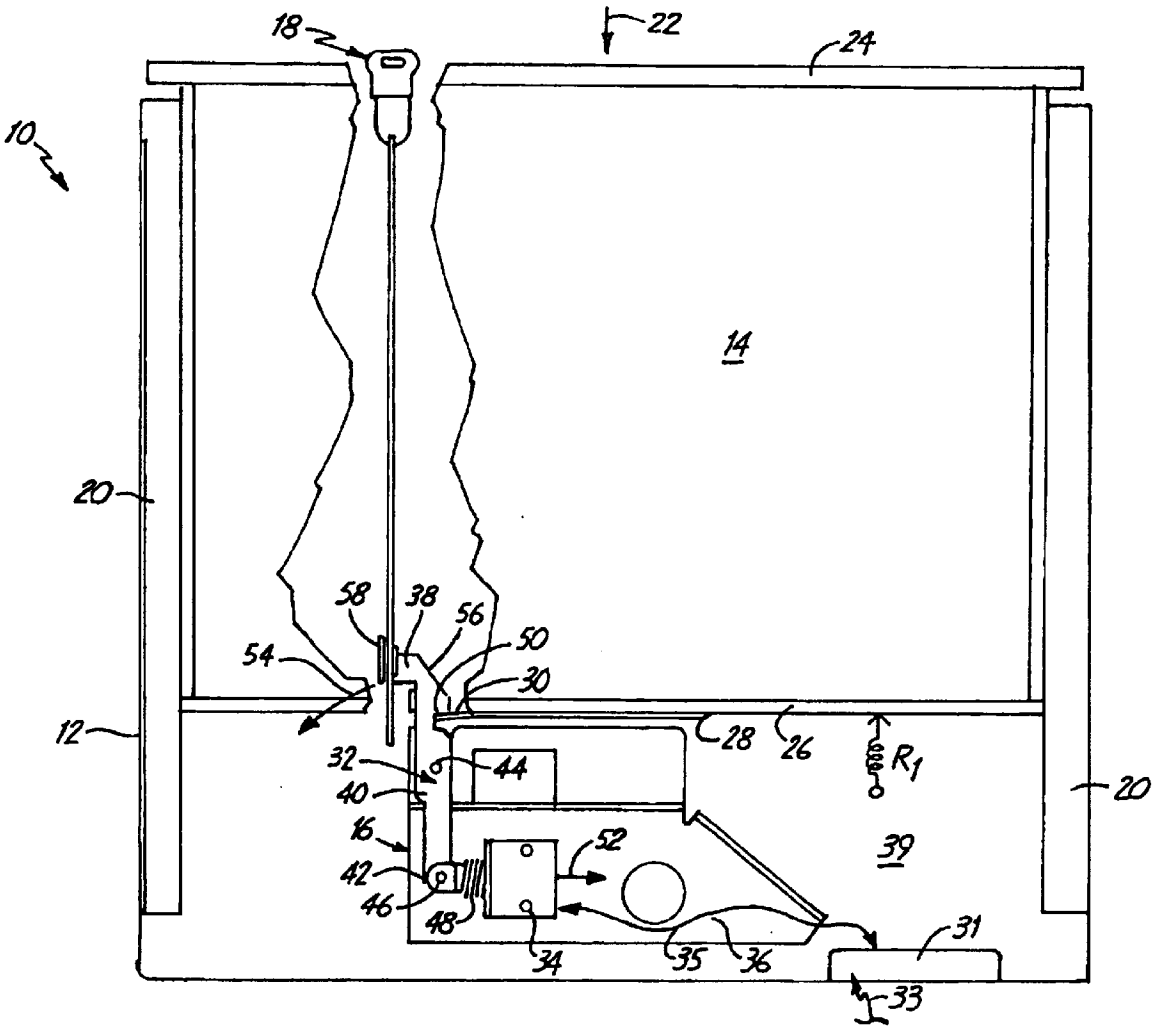
FIG. 1 is an illustration of a cash drawer.

FIG. 1 is a top plan view of a cash drawer assembly 10 according to the present invention. While a wide variety of cash drawers can be used, assembly 10 is described for illustrative purposes only. Cash drawer assembly 10 includes a housing 12, a cash drawer 14, a latch mechanism 16, and a key locking mechanism 18. Drawer 14 is slidably mounted within housing 12 by a pair of slides 20 mounted on opposite sides of housing 12. Drawer 14 is slidable within housing 12 on slides 20 in the directions indicated by arrow 22.

Commonly, a cash tray (not shown) is inserted into drawer 14. The cash tray typically has a number of dividers for storing currency, coupons, and other items required in a cash register system.

Drawer 14 has a front face 24 and a rear panel 26. A locking plate 28 is attached to the rear panel 26. Locking plate 28 extends downwardly from the bottom of rear panel 26 and has a locking tab portion 30 which is substantially co-linear with, and co-planar with, the remainder of plate 28.

Figure 4:
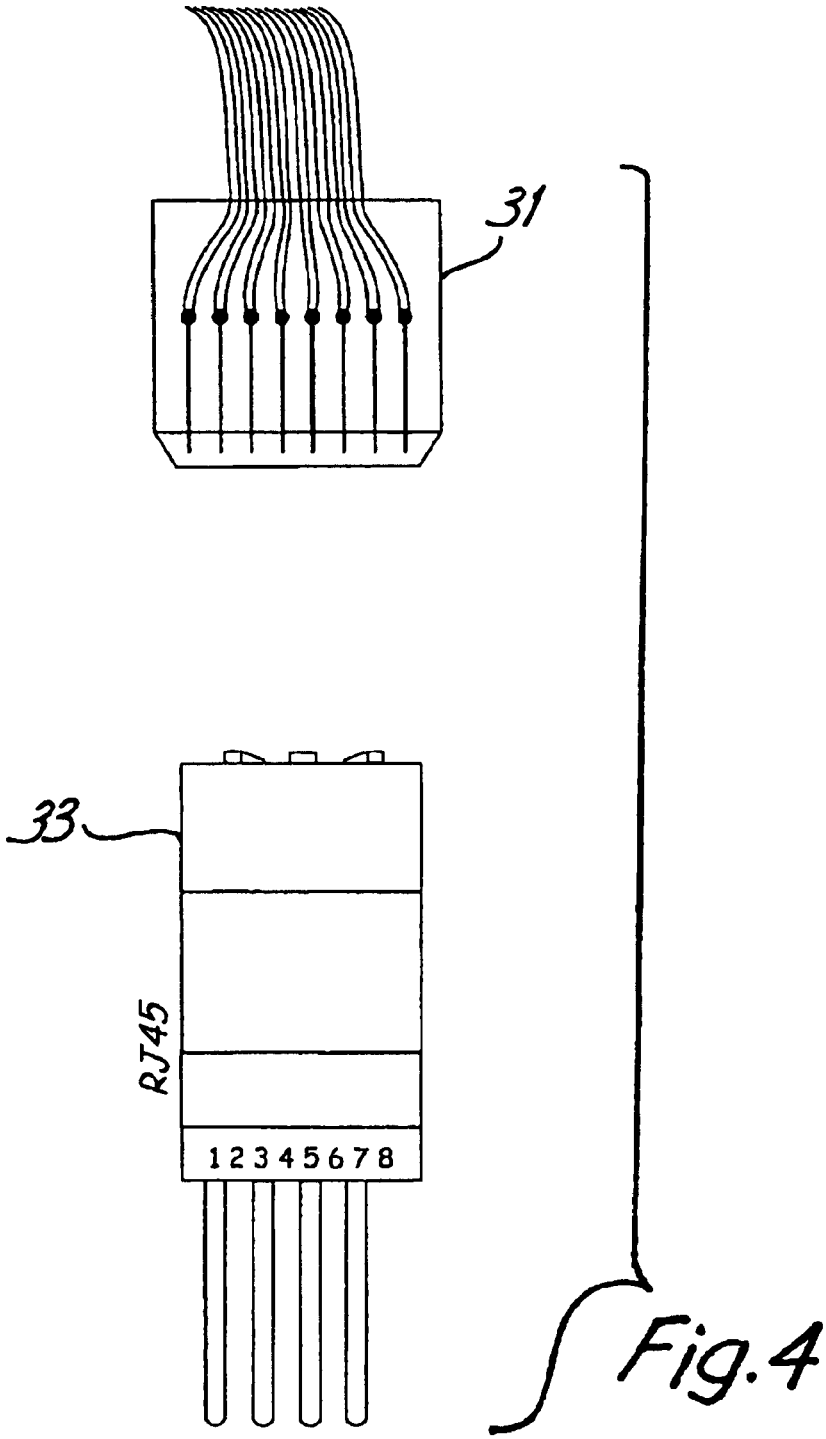
FIG. 4 is a partial cutaway illustration of a cable and connector assembly in accordance with one embodiment of the present invention.

Latch mechanism 16 includes a pivotable rotary latch member 32 (rotary latch 32), and an electrically operated solenoid 34. Rotary latch 32 and solenoid 34 are mounted on a mounting plate 36 which is, in turn, mounted on a base plate 39 of housing 12. Rotary latch 32 has a forward portion 38, an intermediate portion 40 and a rearward portion 42. Rotary latch 32 pivots about pivot point 44 which is disposed generally at the intermediate portion 40 of rotary latch 42. FIG. 4 depicts one embodiment of such a cable and connector assembly. This particular embodiment includes an RJ45 connector.

Solenoid 34 is pivotably coupled to the rear portion 42 at pivot point 46. Solenoid 34 has a compression spring 48 disposed thereon which biases rotary latch 32 into the locking or latching position shown in FIG. 1. When in the locking (or latching) position, a tab engaging surface 50 on the forward portion 38 of rotary latch 32 engages tab 30 of locking plate 28 thereby holding drawer 14 in the closed position shown in FIG. 1. Rotary latch 32 thus inhibits the movement of drawer 14 forwardly, out of housing 12, into an open position.

To open drawer 14, solenoid 34 is energized. This is done by receiving an input signal from an external control component (not shown) over cable and connector assembly 33 which is plugged into jack 31. In one illustrative embodiment, assembly 33 comprises an RJ45 plug. The input signal is provided to solenoid 34 over internal wiring 35 to energize solenoid 34. This causes actuation of the solenoid.

Upon actuation of solenoid 34, compression spring 48 is compressed by the solenoid and the rear portion 42 of rotary latch 32 is moved in a direction indicated by arrow 52. This causes the forward portion 38 of rotary latch 32 to pivot about an arc, generally indicated by arrow 54. As forward portion 38 of rotary latch 32 pivots about arc 54, tab engaging surface 50 disengages from tab portion 30 of plate 28, thus freeing drawer 14 to slide within housing 12.

Cash drawer assembly 10 is conventionally provided with a spring, schematically represented by k1, which is coupled to base plate 39 of housing 12 and which biases drawer 14 to an open position. In the past, such springs have typically taken the form of steel, resilient wire loops (e.g., made of piano wires) coupled to an upstanding post fastened to base plate 39. The wire loops are positioned to engage the rear panel 26 of drawer 14 biasing drawer 14 to an open position. Many other spring configurations can be used as well.

Forward portion 38 of rotary latch 32 is provided with a surface 56 which is disposed at an angle relative to arrow 22. Thus, when drawer 14 is moved from the open position to the closed position, tab portion 30 engages surface 56 causing latch member 32 to rotate along arc 54 until tab portion 30 reaches tab engaging surface 50, at which time rotary latch 32 pivots back to the locking position shown in FIG. 1.

Figure 2:
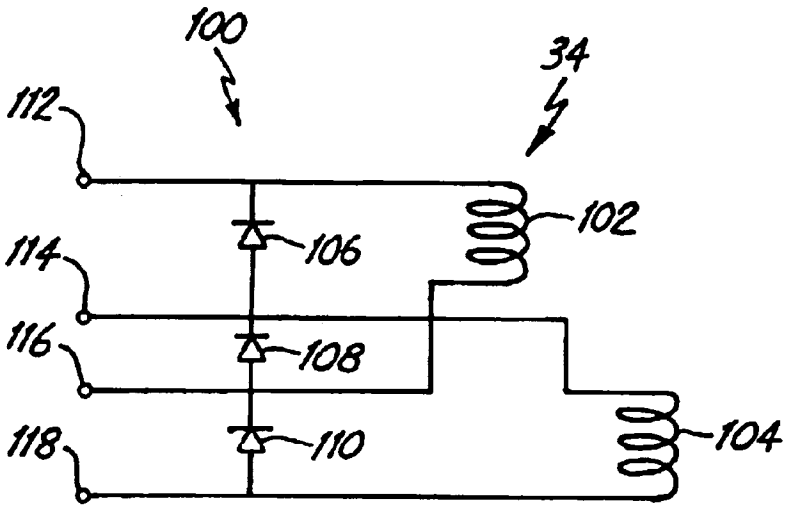
FIG. 2 is a circuit diagram illustrating one embodiment of a multi-voltage solenoid in accordance with one embodiment of the present invention.

FIG. 2 is one embodiment of a circuit 100 illustrating the configuration of a multi-voltage solenoid 34 in accordance with one aspect of the present invention. Circuit 100 includes coils 102 and 104, diodes 106, 108 and 110 and connection pins 112, 114, 116 and 118. In one illustrative embodiment, pins 112–118 extend from the outer package containing coils 102 and 104 and diodes 106, 108 and 110 are electrically connected directly to the pins. This is described in greater detail with respect to FIG. 3 below.

To accommodate operating in the different voltage modes, energization is provided to the various connector pins in the following way.

For example, in order to operate in a 12V mode, positive voltage (+12V) is applied to pin 114 while negative voltage (−12V) is applied to pin 116. This causes coils 102 and 104 to be energized in parallel to achieve 12V operation.

To accommodate 24V operation, positive voltage (+24V) is applied at pin 112 while a negative voltage (−24V) is applied at pin 118. Both coils 102 and 104 operate in series, and fly-back protection is provided through diodes 106, 108 and 110.

The present invention also allows additional voltages, other than 12 volts and 24 volts to actuate the solenoid. For example, if +15V is applied at pin 114 and −15V is applied at pin 118, then only coil 104 is energized, and diodes 108 and 110 prevent coil 102 from energizing. Fly-back protection is provided through diodes 106 and 108. Thus, 15V operation can be accommodated.

By applying a positive voltage to pin 112 and a negative voltage to pin 116, even higher voltages can be accommodated. This is because, in one embodiment, coil 102 is the outer coil in the circuit so the flux density associated with coil 102 is less than that associated with coil 104. Thus, a larger voltage is required to apply the same flux density to the plunger in the solenoid, which requires a higher current. Therefore, by energizing pins 112 and 116, higher voltages can be accommodated, as high as, and in excess of, 28 volts. Diodes 106 and 108 prevent coil 104 from energizing, and diodes 106 and 110 provide fly-back protection.

Figure 3:
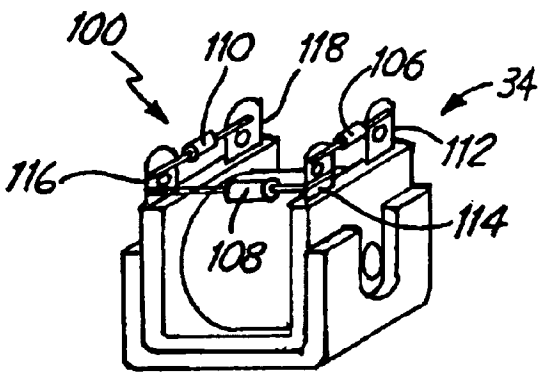
FIG. 3 is a pictorial view of a solenoid in accordance with one embodiment of the present invention.

FIG. 3 is a pictorial illustration of one embodiment of the solenoid 34 containing circuit 100. The pins are labeled similarly to those shown in FIG. 2. FIG. 3 illustrates that diodes 106, 108 and 110 are soldered directly across the pins extending from the solenoid package. This can be done quickly, requiring very little labor.

It can be seen from the above description that diodes 106, 108 and 110 act to select the appropriate coils and to provide fly-back protection when energization is provided at the correct input pins. Thus, the unused input pins (those which do not have energization applied thereto) need not be polarized or jumpered in anyway.

Thus, the present invention can be implemented simply by providing one connector harness or wiring harness for each desired voltage operation mode. This may illustratively be done with RJ45 type connectors. Since those connectors are easy to manufacture and relatively cheap, and since they are quite small, they provide a clean efficient and high quality look and different sets of cables can be manufactured very inexpensively.

It should also be noted that, in accordance with one embodiment, selection of the operation voltage is performed by simply choosing the right wire harness or cables. Therefore, the decision of what voltage the drawer will be configured for need not be made by the manufacturer or even by the distributor, but can simply be made by the customer, at the customer's site. Once that decision is made, the correct cable assembly or wiring harness simply needs to be provided to the customer. The connectors on the wiring harness or cable assembly are plugged into the connectors on the cash drawer, in the same manner, regardless of the particular wiring assembly used with the connector. The wiring in the wiring assembly or cable in simply different. There is no need to access the internal cash drawer electronics for any reason.

Similarly, the customer can easily change the voltage that the cash drawer works with by simply changing the cable assembly. Therefore, if the customer changes the control system being used with the cash drawer, the customer can maintain the equity in the cash drawer and simply invest in a very inexpensive new set of cables such that the cash drawer will operate with the new control system (which provides a different actuation voltage).

It can thus be seen that the present invention provides a cash drawer which can be used with more than two different voltages, without changing the internal configuration of the cash drawer. In addition, the present invention provides a cash drawer which can be used with a plurality of voltages yet still provide fly-back protection. Further, one embodiment of the present invention provides diodes which act not only to select the appropriate coil or coils for energization, but also provide fly-back protection, in a multi-voltage solenoid.

Although the present invention has been described with reference to preferred embodiments, workers skilled in the art will recognize that changes may be made in form and detail without departing from the spirit and scope of the invention.

What is claimed is:

1. A cash drawer comprising:

a housing;

a drawer slidably mounted in the housing;

a latch configured to hold the drawer in a closed position; and an actuator coupled to the latch to move the latch between an unlatching position and a latching position, the actuator being configured to actuate upon receiving an input signal at any one of at least three energization potentials.

2. The cash drawer of claim 1 wherein the actuator comprises:

a solenoid with a plurality of coils, each coil having coil inputs.

3. The cash drawer of claim 2 wherein the actuator comprises:

a diode circuit coupled to the plurality of coils.

4. The cash drawer of claim 3 wherein the diode circuit is configured to apply the input signal to desired coil inputs based on an energization potential of the input signal.

5. The cash drawer of claim 4 and further comprising:

a cable and connector assembly configured to connect the energization potential of the input signal to the diode circuit.

6. The cash drawer of claim 5 wherein the diode circuit is configured to apply the input signal to desired coil inputs based on a configuration of the cable and connector assembly.

7. The cash drawer of claim 6 wherein the plurality of coils comprises first and second coils, each having first and second inputs.

8. The cash drawer of claim 7 wherein the diode circuit comprises:

a first diode connected between the first input of the first coil and the first input of the second coil;

a second diode connected between the first input of the second coil and the second input of the first coil; and a third diode connected between the second input of the first coil and the second input of the second coil.

9. The cash drawer of claim 1 wherein the at least three voltage potentials include 12V and 24V and at least one additional voltage.

10. The cash drawer of claim 9 wherein the at least one additional voltage comprises 15V and at least 28V.

11. The cash drawer of claim 9 wherein the actuator includes a diode circuit configured to provide fly-back protection.

12. A cash drawer, comprising:

a housing;

a drawer reciprocally mounted within the housing;

a latch movable between a latching position holding the drawer in the housing and an unlatching position;

an actuator coupled to the latch to move the latch between the latching and unlatching positions based on a predetermined energization signal; and an energization circuit receiving an input signal at any one of a plurality of voltage potentials and applying the predetermined energization signal to the actuator, the energization circuit including a plurality of coils providing the predetermined energization signal to the actuator and a selection circuit applying the input signal to one or more of the coils and de-energizing the coils, inhibiting application of de-energizing current to components remote from the cash drawer.

13. The cash drawer of claim 12 wherein the energization circuit is configured to receive the input signal at any one of at least three voltage potentials.

14. The cash drawer of claim 12 wherein the selection circuit comprises:

a diode circuit coupled to the plurality of coils.

15. The cash drawer of claim 14 wherein the diode circuit is configured to apply the inputs to desired coil inputs based on an energization potential of the input signal.

16. The cash drawer of claim 15 and further comprising:

a cable and connector assembly configured to connect the energization potential of the input signal to the diode circuit.

17. The cash drawer of claim 16 wherein the diode circuit is configured to apply the input signal to desired coil inputs based on a configuration of the cable and connector assembly.

18. The cash drawer of claim 17 wherein the cable and connector assembly includes an RJ45 connector.

19. A cash drawer latch assembly, in a cash drawer comprising:

a latch movable between a latching position and an unlatching position; and an actuator energizeable to move the latch between the latching and unlatching positions, the actuator including a plurality of coils and a diode circuit the diode circuit receiving an input signal at one of a plurality of voltages, and de-energizing the coils inhibiting application of de-energization to components external to the cash drawer.

20. The cash drawer latch assembly of claim 19 and further comprising:

a cable and connector assembly configured to connect the energization potential of the input signal to the diode circuit.

21. The cash drawer latch assembly of claim 20 wherein the diode circuit is configured to apply the input signal to desired coil inputs based on a configuration of the cable and connector assembly.

* * * * *